US012612147B2

(12) United States Patent
Shirao et al.

(10) Patent No.: US 12,612,147 B2
(45) Date of Patent: Apr. 28, 2026

(54) SHIP LAUNCHING SUPPORT SYSTEM, SHIP CONTROL DEVICE, SHIP LAUNCHING SUPPORT METHOD AND PROGRAM

(71) Applicant: NHK SPRING Co., Ltd., Kanagawa (JP)

(72) Inventors: Masato Shirao, Yokohama (JP); Marino Sato, Yokohama (JP); Jun Tokushige, Yokohama (JP); Takafumi Kamiya, Yokohama (JP)

(73) Assignee: NHK SPRING CO., LTD., Kanagawa (JP)

( * ) Notice: Subject to any disclaimer, the term of this patent is extended or adjusted under 35 U.S.C. 154(b) by 155 days.

(21) Appl. No.: 18/409,032

(22) Filed: Jan. 10, 2024

(65) Prior Publication Data

US 2024/0140581 A1 May 2, 2024

Related U.S. Application Data

(63) Continuation of application No. PCT/JP2022/026245, filed on Jun. 30, 2022.

(30) Foreign Application Priority Data

Jul. 12, 2021 (JP) ..... 2021-115239

(51) Int. Cl.
*B63H 25/42* (2006.01)

(52) U.S. Cl.
CPC ..... *B63H 25/42* (2013.01)

(58) Field of Classification Search
CPC .. B63H 25/42; B63H 21/21; B63H 2021/216; B63H 25/04; B63H 25/46; B63B 34/10; B63C 3/12
See application file for complete search history.

(56) References Cited

U.S. PATENT DOCUMENTS 4,976,211 A 12/1990 Reinhardt
5,142,473 A 8/1992 Davis
(Continued)

FOREIGN PATENT DOCUMENTS

JP 2011-189847 A 9/2011
WO WO2016/163559 A1 10/2016

OTHER PUBLICATIONS

Supplementary European Search Report in counterpart application No. EP 22841966.9, dated Oct. 22, 2024.
(Continued)

*Primary Examiner* — Rachid Bendidi
*Assistant Examiner* — Nada Mahyoob Alqaderi
(74) *Attorney, Agent, or Firm* — Greenblum & Bernstein, P.L.C.

(57) ABSTRACT

A ship launching support system configured to support launching work of a ship of disengaging the ship from a trailer on which the ship is loaded, the ship including an actuator having a function of generating propulsion power of the ship and a function of generating a moment on the ship, and a ship control device configured to actuate the actuator, during the launching work of the ship, the ship control device causing the actuator to generate backward propulsion power of the ship, and executing feedback control of a bow azimuth of the ship on the basis of a deviation between an actual bow azimuth that is a bow azimuth of the ship in actuality and a target bow azimuth.

17 Claims, 6 Drawing Sheets

(56) References Cited

U.S. PATENT DOCUMENTS

| | | | | |
|---|---|---|---|---|
| 5,228,713 | A | 7/1993 | Kovach | |
| 9,598,160 | B2 * | 3/2017 | Andrasko | B63H 20/08 |
| 9,764,810 | B1 * | 9/2017 | Andrasko | B63H 20/10 |
| 9,821,808 | B1 * | 11/2017 | Abbas | B62D 15/027 |
| 2007/0113769 | A1 | 5/2007 | Stallings et al. | |
| 2011/0166724 | A1 * | 7/2011 | Hiramatsu | B63H 25/42 702/85 |
| 2016/0368578 | A1 | 12/2016 | Walke | |
| 2018/0050772 | A1 * | 2/2018 | Koyano | B63H 21/21 |
| 2019/0300138 | A1 * | 10/2019 | Akuzawa | G05D 1/02 |
| 2019/0361446 | A1 * | 11/2019 | Ward | B63H 25/42 |

OTHER PUBLICATIONS

International Search Report in International Application No. PCT/JP2022/026245, dated Oct. 4, 2022, along with an English translation thereof.

* cited by examiner

SHIP LAUNCHING SUPPORT SYSTEM, SHIP CONTROL DEVICE, SHIP LAUNCHING SUPPORT METHOD AND PROGRAM

TECHNICAL FIELD

The present invention relates to a ship launching support system, a ship control device, a ship launching support method and a program.

This application is a Bypass Continuation of International Patent Application No. PCT/JP2022/026245, filed Jun. 30, 2022. Priority is claimed on Japanese Patent Application No. 2021-115239, filed Jul. 12, 2021, the content of which is incorporated herein by reference.

BACKGROUND ART

In the related art, a trailing system configured to disengage a ship from a trailer is known (for example, see Patent Document 1). In the technology disclosed in Patent Document 1, when the ship is moved (disengaged) from the trailer to a water surface (upon disengagement), the trailer is moved to a slope (ramp), the ship is automatically moved away from the trailer, and thus disengaging work is automatically performed. Specifically, upon the disengaging work of the ship, it is determined whether there is an obstacle behind or near the ship, and backward propulsion of the ship in a direction in which the ship is disengaged from the trailer is feedback-controlled on the basis of a distance between the ship and the trailer.

Patent Document 1 discloses an embodiment in which a transmitter is provided on the trailer and an embodiment in which a transmitter is not provided on the trailer.

Incidentally, in the technology disclosed in Patent Document 1, when a distance between the ship and the trailer exceeds a predetermined threshold, it is determined that the ship is disengaged from the trailer, and although the ship is held at a fixed point, there is no control of a bow azimuth of the ship during the disengaging work of the ship.

For this reason, in the technology disclosed in Patent Document 1, the disengaging work of the ship may become unstable (that is, it may not be possible to achieve safe disengaging work of the ship).

Patent Document 2 discloses backward launching that is a launching method of submerging a hull rear part and moving the hull underwater from the trailer using propulsion power of a jet propeller. In the technology disclosed in Patent Document 2, during backward launching, an engine speed is constantly controlled, and a decrease in propulsion power due to air draw is minimized.

Incidentally, even in the technology disclosed in Patent Document 2, during backward launching, control of the bow azimuth of the ship is not performed.

For this reason, even in the technology disclosed in Patent Document 2, disengaging work of the ship may become unstable (that is, it may not be possible to achieve safe disengaging work of the ship).

CITATION LIST

Patent Document

[Patent Document 1]

PCT International Publication No. 2016/163559

[Patent Document 2]

Japanese Unexamined Patent Application, First Publication No. 2011-189847

SUMMARY OF INVENTION

Technical Problem

In consideration of the above-mentioned problems, the present invention is directed to providing a ship launching support system, a ship control device, a ship launching support method and a program that are capable of realizing safe and simple launching work (disengaging work) of a ship.

Solution to Problem

An aspect of the present invention is a ship launching support system configured to support launching work of a ship of disengaging the ship from a trailer on which the ship is loaded, the ship including: an actuator having a function of generating propulsion power of the ship and a function of generating a moment on the ship; and a ship control device configured to actuate the actuator, during the launching work of the ship, the ship control device causing the actuator to generate backward propulsion power of the ship, and executing feedback control of a bow azimuth of the ship on the basis of a deviation between an actual bow azimuth that is a bow azimuth of the ship in actuality and a target bow azimuth.

An aspect of the present invention is a ship control device configured to actuate an actuator having a function of generating propulsion power of a ship and a function of generating a moment in the ship, during launching work of the ship in which the ship is disengaged from a trailer on which the ship is loaded, the ship control device causing the actuator to generate backward propulsion power of the ship, and executing feedback control of a bow azimuth of the ship on the basis of a deviation between the target bow azimuth and the actual bow azimuth of the ship.

An aspect of the present invention is a ship launching support method of supporting launching work of a ship of disengaging the ship from a trailer on which the ship including an actuator having a function of generating propulsion power of the ship and a function of generating a moment in the ship is loaded, the ship launching support method including: a backward propulsion power generating step of causing the actuator to generate backward propulsion power of the ship; and a feedback control step of executing feedback control of a bow azimuth of the ship on the basis of a deviation between a target bow azimuth and an actual bow azimuth of the ship.

An aspect of the present invention is a program configured to cause a computer mounted on a ship including an actuator having a function of generating propulsion power of the ship and a function of generating a moment in the ship to execute: a backward propulsion power generating step of causing the actuator to generate backward propulsion power of the ship; and a feedback control step of executing feedback control of a bow azimuth of the ship on the basis of a deviation between a target bow azimuth and an actual bow azimuth of the ship, during launching work of the ship of disengaging the ship from a trailer on which the ship is loaded.

Advantageous Effects of Invention

According to the present invention, it is possible to provide a ship launching support system, a ship control device, a ship launching support method and a program that are capable of realizing safe and simple launching work of a ship.

DESCRIPTION OF EMBODIMENTS

First Embodiment

Hereinafter, a first embodiment of a ship launching support system, a ship control device, a ship launching support method and a program of the present invention will be described.

Figure 1:
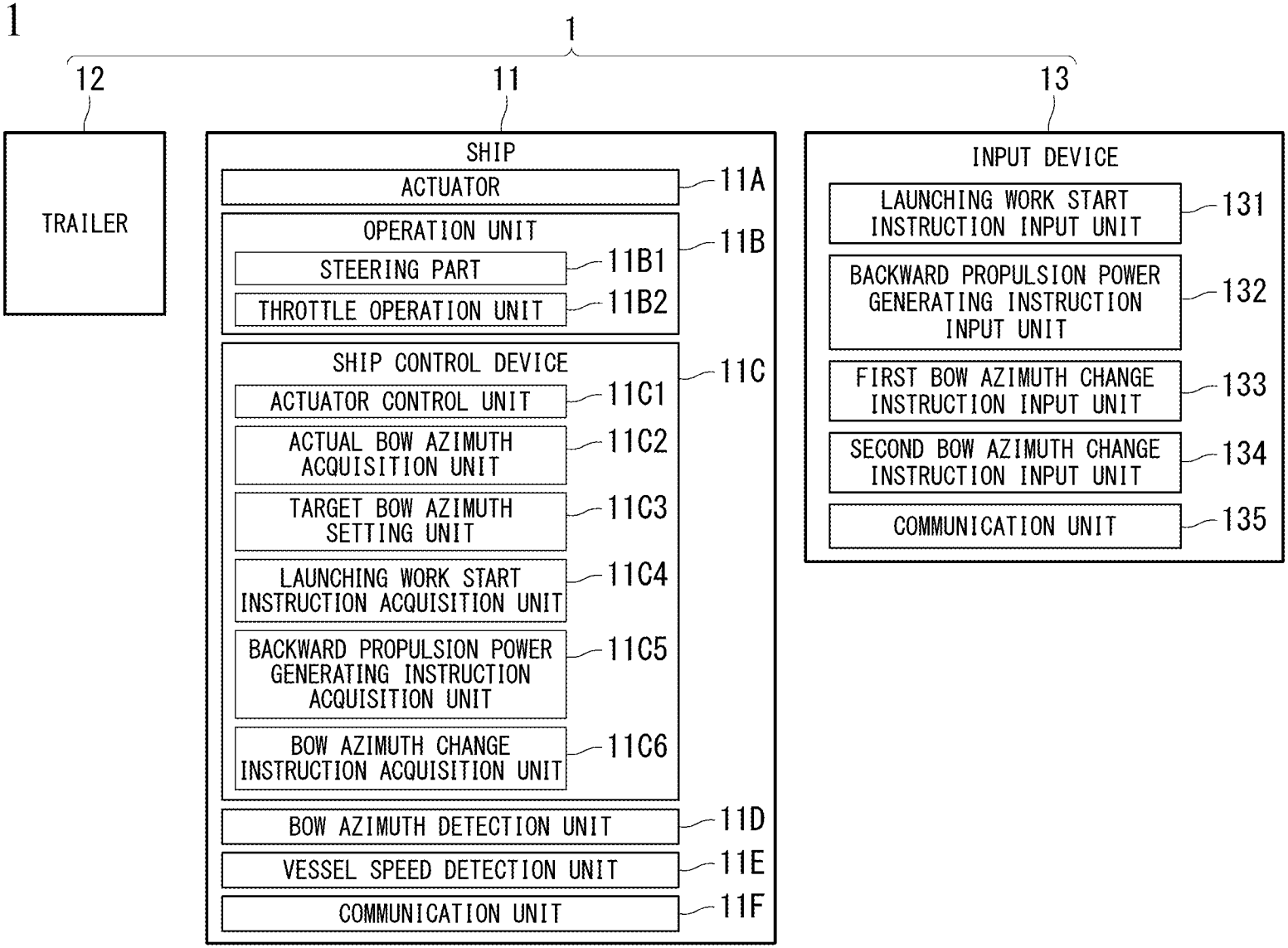
FIG. 1 is a view showing an example of a ship launching support system to which a ship control device of a first embodiment is applied.

FIG. 1 is a view showing an example of a ship launching support system 1 to which a ship control device 11C of a first embodiment is applied.

In the example shown in FIG. 1, the ship launching support system 1 includes a ship 11, a trailer 12, and an input device 13. The ship launching support system 1 supports launching work of the ship 11 in which the ship 11 is disengaged from the trailer 12 on which the ship 11 is loaded.

The ship 11 is, for example, a personal watercraft (PWC, water scooter) having the same function as that provided in the PWC disclosed in FIG. 1 of Japanese Patent No. 5196649. The ship 11 includes an actuator 11A, an operation unit 11B, the ship control device 11C, a bow azimuth detection unit 11D, a vessel speed detection unit 11E, and a communication unit 11F.

The actuator 11A has a function of generating propulsion power of the ship 11 and a function of generating a moment in the ship 11. The actuator 11A includes, for example, an engine, a nozzle, a deflector, a trim actuator, a bucket, a bucket actuator, and the like, disclosed in FIG. 1 of Japanese Unexamined Patent Application, First Publication No. 2019-171925.

The operation unit 11B receives an input operation of a ship operator of the ship 11. The operation unit 11B includes, for example, a steering part 11B1, and a throttle operation unit 11B2. As the steering part 11B1 receives the input operation of the ship operator, the actuator 11A generates a moment in the ship 11. The throttle operation unit 11B2 causes the actuator 11A to receive the input operation of the ship operator that generates propulsion power of the ship 11.

The ship control device 11C performs control or the like of the actuator 11A. The ship control device 11C includes an actuator control unit 11C1, an actual bow azimuth acquisition unit 11C2, a target bow azimuth setting unit 11C3, a launching work start instruction acquisition unit 11C4, a backward propulsion power generating instruction acquisition unit 11C5, and a bow azimuth change instruction acquisition unit 11C6.

The actuator control unit 11C1 performs control of the actuator 11A. That is, the actuator control unit 11C1 actuates the actuator 11A.

The actual bow azimuth acquisition unit 11C2 acquires an actual bow azimuth (a real bow azimuth of the ship 11) of the ship 11 detected by the bow azimuth detection unit 11D. The "bow azimuth" is an azimuth on a horizontal plane indicated by the bow of the ship 11, and in general, is expressed by an angle formed with respect to a reference azimuth. Conventionally, true north is expressed as "0°," true east is expressed as "90°," true south is expressed as "180°," and true west is expressed as "270°."

The target bow azimuth setting unit 11C3 sets a target bow azimuth of the ship 11 during the launching work of the ship 11.

The launching work start instruction acquisition unit 11C4 acquires a start instruction of the launching work of the ship 11 received by the input device 13. The backward propulsion power generating instruction acquisition unit 11C5 acquires an instruction to generate backward propulsion power of the ship 11 received by the input device 13. The bow azimuth change instruction acquisition unit 11C6 acquires an instruction to change a bow azimuth of the ship 11 received by the input device 13.

The bow azimuth detection unit 11D detects an actual bow azimuth of the ship 11. The bow azimuth detection unit 11D includes, for example, an azimuth sensor. The azimuth sensor calculates an actual bow azimuth of the ship 11 using, for example, terrestrial magnetism.

In another example, the azimuth sensor may be a device (gyro compass) in which a north-indicating device and a damping device are added to a gyroscope that rotates at a high speed to always indicate north.

Further, in the other example, the azimuth sensor includes a plurality of Global Positioning System (GPS) antennae, and may be a GPS compass configured to calculate a bow azimuth from a relative positional relation between the plurality of GPS antennae. In the example shown in FIG. 1, the vessel speed detection unit 11E detects a speed of the ship 11. The vessel speed detection unit 11E may be, for example, a water pressure sensing type configured to detect a counter-water speed of the ship 11, or may be a GPS measurement type configured to detect a ground speed of the ship 11.

In the other example, the ship 11 may not have the vessel speed detection unit 11E.

In the example shown in FIG. 1, the communication unit 11F performs communication with the input device 13. Specifically, the communication unit 11F receives, for example, an instruction to start the launching work of the ship 11 or the like from the input device 13.

The trailer 12 carries the ship 11 that is the target of launching work.

The input device 13 receives an input of the instruction to start the launching work of the ship 11 in which the ship 11 is disengaged from the trailer 12 or the like. The input device 13 is, for example, a dedicated controller, a portable terminal device (for example, a smartphone or the like) carried by a launching worker, or the like, which is separate from the ship 11. The input device 13 includes a launching work start instruction input unit 131, a backward propulsion power generating instruction input unit 132, a first bow azimuth change instruction input unit 133, a second bow azimuth change instruction input unit 134, and a communication unit 135.

The launching work start instruction input unit 131 receives, for example, an input of a start instruction of launching work of the ship 11 by a launching worker of the ship 11. The backward propulsion power generating instruction input unit 132 receives, for example, an input of a generating instruction of backward propulsion power of the ship 11 by a launching worker of the ship 11.

The first bow azimuth change instruction input unit 133 receives, for example, an input of a left-handed (counterclockwise) rotation change instruction of a bow azimuth of the ship 11 by a launching worker of the ship 11. The second bow azimuth change instruction input unit 134 receives, for example, an input of a right-handed (clockwise) rotation change instruction of a bow azimuth of the ship 11 by a launching worker of the ship 11.

The communication unit 135 performs communication with the communication unit 11F of the ship 11. Specifically, the communication unit 135 transmits an instruction received by each of the launching work start instruction input unit 131, the backward propulsion power generating instruction input unit 132, the first bow azimuth change instruction input unit 133 and the second bow azimuth change instruction input unit 134 to the communication unit 11F of the ship 11.

Specifically, the target bow azimuth setting unit 11C3 of the ship control device 11C of the ship 11 sets a target bow azimuth of the ship 11 in a duration (first duration) in which the ship 11 is disengaged from the trailer 12 from a time when the launching work start instruction input unit 131 of the input device 13 receives the input of the instruction to start the launching work during the launching work of the ship 11, and a target bow azimuth of the ship 11 in a duration (second duration) after the ship 11 is disengaged from the trailer 12.

Figure 2:
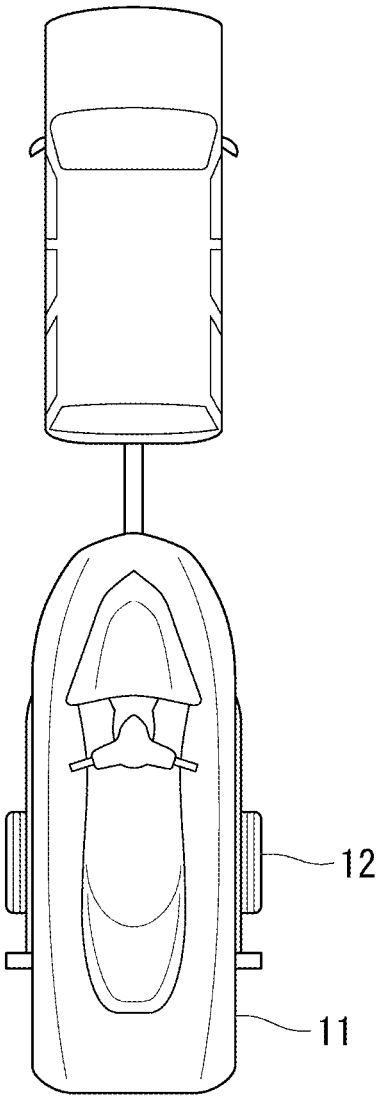
FIG. 2 is a view showing an example of a relation between a ship and a trailer upon start of ship launching work in which the ship is disengaged from the trailer.

FIG. 2 is a view showing an example of a relation between the ship 11 and the trailer 12 upon starting of launching work of the ship 11, in which the ship 11 is disengaged from the trailer 12. That is, FIG. 2 shows an example of a relation between the ship 11 and the trailer 12 at timing disclosed in FIG. 15 of Patent Document 2.

In the example shown in FIG. 2, in a state in which the ship 11 is loaded on the trailer 12, the launching work start instruction input unit 131 of the input device 13 receives, for example, an input of a start instruction of launching work of the ship 11 by a launching worker of the ship 11. The bow azimuth detection unit 11D of the ship 11 detects an actual bow azimuth of the ship 11 when the launching work start instruction input unit 131 receives an input of a start instruction of launching work of the ship 11 (specifically, when the launching work start instruction acquisition unit 11C4 of the ship control device 11C acquires a start instruction of launching work of the ship 11 transmitted from the input device 13).

The target bow azimuth setting unit 11C3 of the ship control device 11C sets an actual bow azimuth of the ship 11 detected by the bow azimuth detection unit 11D when the launching work start instruction input unit 131 receives an input of a start instruction of launching work of the ship 11 as a target bow azimuth of the ship 11 during launching work of the ship 11 (in the above-mentioned first duration and second duration).

That is, the target bow azimuth of the ship 11 set by the target bow azimuth setting unit 11C3 at this time is used as a target bow azimuth of the ship 11 in the duration (i.e., in the first duration and the second duration) until the launching work of the ship 11 is terminated.

Figure 3:
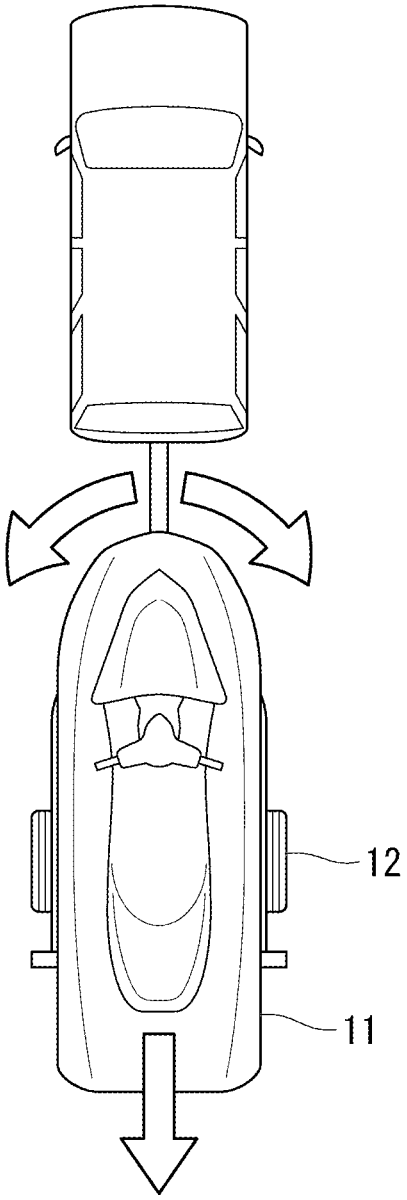
FIG. 3 is a view showing an example of a relation between the ship and the trailer when a backward propulsion power generating instruction input unit of an input device receives an input of an instruction to generate backward propulsion power of the ship.

FIG. 3 is a view showing an example of a relation between the ship 11 and the trailer 12 when the backward propulsion power generating instruction input unit 132 of the input device 13 receives an input of a generating instruction of backward propulsion power of the ship 11.

In the example shown in FIG. 3, after the bow azimuth detection unit 11D of the ship 11 detects an actual bow azimuth of the ship 11, the backward propulsion power generating instruction input unit 132 of the input device 13 receives, for example, an input of a generating instruction of backward propulsion power of the ship 11 by a launching worker of the ship 11.

Next, the actuator control unit 11C1 of the ship control device 11C causes the actuator 11A to generate backward propulsion power of the ship 11 as shown by a linear arrow in FIG. 3 and starts bow azimuth holding control of the ship 11 of holding the actual bow azimuth of the ship 11 at a target bow azimuth of the ship 11 according to the input of the generating instruction of the backward propulsion power of the ship 11 received by the backward propulsion power generating instruction input unit 132 of the input device 13 (specifically, according to the generating instruction of the backward propulsion power of the ship 11 acquired by the backward propulsion power generating instruction acquisition unit 11C5 of the ship control device 11C).

That is, during the launching work of the ship 11 (specifically, in the first duration and the second duration), the actuator control unit 11C1 of the ship control device 11C causes the actuator 11A to generate the backward propulsion power of the ship 11 and execute feedback control of the bow azimuth of the ship 11 on the basis of a deviation between the actual bow azimuth and the target bow azimuth of the ship 11.

Meanwhile, since a frictional force is generated between the ship 11 and the trailer 12, in a state in which the actual bow azimuth of the ship 11 is held at the target bow azimuth of the ship 11, the ship 11 may not be able to disengage from the trailer 12 if the actuator 11A only generates backward propulsion power of the ship 11.

In this case, the first bow azimuth change instruction input unit 133 of the input device 13 receives, for example, an input of a left-handed (counterclockwise) rotation change instruction of the bow azimuth of the ship 11 by the launching worker of the ship 11, or the second bow azimuth change instruction input unit 134 of the input device 13 receives, for example, an input of a right-handed (clockwise) rotation change instruction of the bow azimuth of the ship 11 by the launching worker of the ship 11.

When the first bow azimuth change instruction input unit 133 receives an input of a left-handed rotation change instruction of the bow azimuth of the ship 11, the actuator 11A of the ship 11 generates a counterclockwise moment in the ship 11 as shown by a left-handed rotation arrow of FIG. 3 according to the input of the left-handed rotation change instruction of the bow azimuth of the ship 11 received by the first bow azimuth change instruction input unit 133 (specifically, according to the left-handed rotation change instruction of the bow azimuth of the ship 11 acquired by the bow azimuth change instruction acquisition unit 11C6 of the ship control device 11C).

When the second bow azimuth change instruction input unit 134 receives an input of a right-handed rotation change instruction of the bow azimuth of the ship 11, the actuator 11A of the ship 11 generates a clockwise moment in the ship 11 as shown by a right-handed rotation arrow in FIG. 3 according to the input of the right-handed rotation change instruction of the bow azimuth of the ship 11 received by the second bow azimuth change instruction input unit 134 (specifically, according to the right-handed rotation change instruction of the bow azimuth of the ship 11 acquired by the bow azimuth change instruction acquisition unit 11C6 of the ship control device 11C).

As a result, the ship 11 is disengaged from the trailer 12 (i.e., the above-mentioned first duration is terminated).

Specifically, as shown in FIG. 3, after the actuator control unit 11C1 of the ship control device 11C starts bow azimuth holding control of the ship 11 of holding the actual bow azimuth of the ship 11 at the target bow azimuth of the ship 11, when the first bow azimuth change instruction input unit 133 of the input device 13 receives the input of the left-handed rotation change instruction of the bow azimuth of the ship 11, the actuator control unit 11C1 of the ship control device 11C interrupts the bow azimuth holding control of the ship 11 of holding the actual bow azimuth of the ship 11 at the target bow azimuth of the ship 11, and causes the actuator 11A to change the bow azimuth of the ship 11 to the left-handed rotation according to the input of the left-handed rotation change instruction of the bow azimuth of the ship 11 received by the first bow azimuth change instruction input unit 133.

After the actuator control unit 11C1 of the ship control device 11C causes the actuator 11A to change the bow azimuth of the ship 11 to the left-handed rotation, when the first bow azimuth change instruction input unit 133 of the input device 13 does not receive the input of the left-handed rotation change instruction of the bow azimuth of the ship 11, the actuator control unit 11C1 of the ship control device 11C restarts the bow azimuth holding control of the ship 11 of holding the actual bow azimuth of the ship 11 at the target bow azimuth of the ship 11.

In addition, as shown in FIG. 3, after the actuator control unit 11C1 of the ship control device 11C starts the bow azimuth holding control of the ship 11 of holding the actual bow azimuth of the ship 11 at the target bow azimuth of the ship 11, when the second bow azimuth change instruction input unit 134 of the input device 13 receives the input of the right-handed rotation change instruction of the bow azimuth of the ship 11, the actuator control unit 11C1 of the ship control device 11C interrupts the bow azimuth holding control of the ship 11 of holding the actual bow azimuth of the ship 11 at the target bow azimuth of the ship 11, and causes the actuator 11A to change the bow azimuth of the ship 11 to the right-handed rotation according to the input of the right-handed rotation change instruction of the bow azimuth of the ship 11 received by the second bow azimuth change instruction input unit 134.

After the actuator control unit 11C1 of the ship control device 11C causes the actuator 11A to change the bow azimuth of the ship 11 to the right-handed rotation, when the second bow azimuth change instruction input unit 134 of the input device 13 does not receive the input of the right-handed rotation change instruction of the bow azimuth of the ship 11, the actuator control unit 11C1 of the ship control device 11C restarts the bow azimuth holding control of the ship 11 of holding the actual bow azimuth of the ship 11 at the target bow azimuth of the ship 11.

In the example shown in FIG. 3, after the actuator control unit 11C1 of the ship control device 11C starts the bow azimuth holding control of the ship 11 of holding the actual bow azimuth of the ship 11 at the target bow azimuth of the ship 11, when the first bow azimuth change instruction input unit 133 of the input device 13 receives the input of the left-handed rotation change instruction of the bow azimuth of the ship 11, the actuator control unit 11C1 of the ship control device 11C causes the actuator 11A to change the bow azimuth of the ship 11 to the left-handed rotation by a preset angle according to the input of the left-handed rotation change instruction of the bow azimuth of the ship 11 received by the first bow azimuth change instruction input unit 133.

Similarly, after the actuator control unit 11C1 of the ship control device 11C starts the bow azimuth holding control of the ship 11 of holding the actual bow azimuth of the ship 11 at the target bow azimuth of the ship 11, when the second bow azimuth change instruction input unit 134 of the input device 13 receives the input of the right-handed rotation change instruction of the bow azimuth of the ship 11, the actuator control unit 11C1 of the ship control device 11C causes the actuator 11A to change the bow azimuth of the ship 11 to the right-handed rotation by a preset angle according to the input of the right-handed rotation change instruction of the bow azimuth of the ship 11 received by the second bow azimuth change instruction input unit 134.

In the other example, after the actuator control unit 11C1 of the ship control device 11C starts the bow azimuth holding control of the ship 11 of holding the actual bow azimuth of the ship 11 at the target bow azimuth of the ship 11, when the first bow azimuth change instruction input unit 133 of the input device 13 receives the input of the left-handed rotation change instruction of the bow azimuth of the ship 11, the actuator control unit 11C1 of the ship control device 11C may cause the actuator 11A to increase the left-handed rotation change amount of the bow azimuth of the ship 11 by a preset angle whenever a predetermined time elapses in a duration in which the first bow azimuth change instruction input unit 133 receives the input of the left-handed rotation change instruction of the bow azimuth of the ship 11.

Similarly, after the actuator control unit 11C1 of the ship control device 11C starts the bow azimuth holding control of the ship 11 of holding the actual bow azimuth of the ship 11 at the target bow azimuth of the ship 11, when the second bow azimuth change instruction input unit 134 of the input device 13 receives the input of the right-handed rotation change instruction of the bow azimuth of the ship 11, the actuator control unit 11C1 of the ship control device 11C may cause the actuator 11A to increase the right-handed rotation change amount of the bow azimuth of the ship 11 by a preset angle whenever a predetermined time elapses in a duration in which the second bow azimuth change instruction input unit 134 receives the input of the right-handed rotation change instruction of the bow azimuth of the ship 11.

Figure 4:
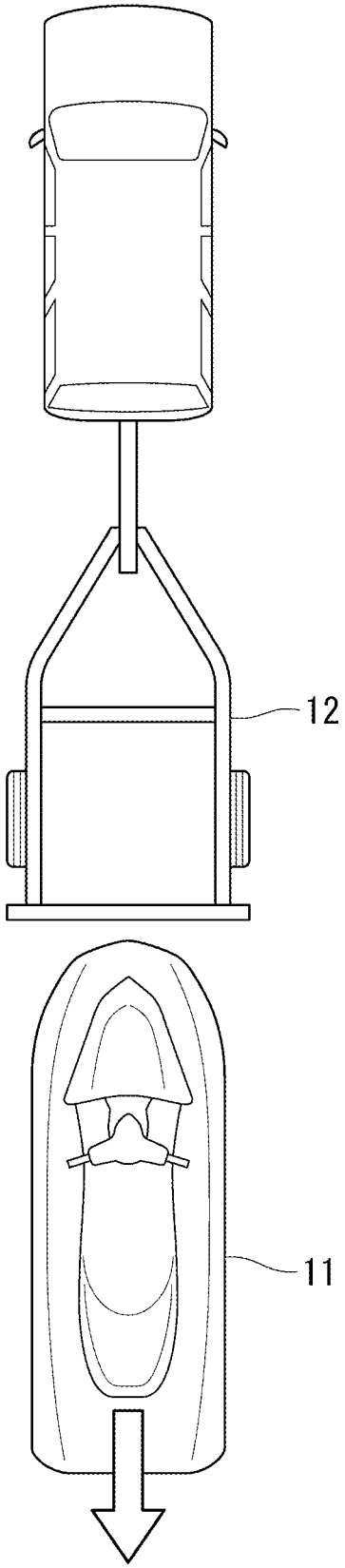
FIG. 4 is a view showing an example of a relation between the ship and the trailer after the ship is disengaged from the trailer.

FIG. 4 is a view showing an example of a relation between the ship 11 and the trailer 12 after the ship 11 is disengaged from the trailer 12 (i.e., in the above-mentioned second duration).

In the example shown in FIG. 4, the actuator control unit 11C1 of the ship control device 11C causes the actuator 11A not to change the bow azimuth of the ship 11 to the left-handed rotation according to the input of the left-handed rotation change instruction of the bow azimuth of the ship 11 received by the first bow azimuth change instruction input unit 133 of the input device 13, further, the actuator control unit 11C1 of the ship control device 11C causes the actuator 11A not to change the bow azimuth of the ship 11 to the right-handed rotation according to the input of the right-handed rotation change instruction of the bow azimuth of the ship 11 received by the second bow azimuth change instruction input unit 134, the actuator control unit 11C1 of the ship control device 11C causes the actuator 11A to generate the backward propulsion power of the ship 11 as shown by a linear arrow of FIG. 3 according to the input of the generating instruction of the backward propulsion power of the ship 11 received by the backward propulsion power generating instruction input unit 132, and as a result, the ship 11 is disengaged from the trailer 12.

The bow azimuth holding control of the ship 11 of holding the actual bow azimuth of the ship 11 at the target bow azimuth of the ship 11 started by the actuator control unit 11C1 of the ship control device 11C is continued in a step shown in FIG. 4 (i.e., in the second duration). That is, the target bow azimuth setting unit 11C3 sets the actual bow azimuth of the ship 11 detected by the bow azimuth detection unit 11D when the launching work start instruction input unit 131 receives the input of the start instruction of the launching work as the target bow azimuth of the ship 11 in the duration (the second duration) after the ship 11 is disengaged from the trailer 12. For this reason, as shown by a linear arrow in FIG. 4, the ship 11 goes straight with the actual bow azimuth of the ship 11 being held at the target bow azimuth of the ship 11.

In the other example, the ship 11 is disengaged from the trailer 12 in the duration in which the actuator control unit 11C1 of the ship control device 11C causes the actuator 11A to change the bow azimuth of the ship 11 to the left-handed rotation according to the input of the left-handed rotation change instruction of the bow azimuth of the ship 11 received by the first bow azimuth change instruction input unit 133 of the input device 13.

When the ship 11 is disengaged from the trailer 12, the change speed of the actual bow azimuth of the ship 11 detected by the bow azimuth detection unit 11D of the ship 11 exceeds a predetermined threshold.

Here, in this example, when the change speed of the actual bow azimuth of the ship 11 detected by the bow azimuth detection unit 11D of the ship 11 exceeds the predetermined threshold, the ship control device 11C determines that the ship 11 is disengaged from the trailer 12 (i.e., it becomes the second duration). Even when the first bow azimuth change instruction input unit 133 receives the input of the left-handed rotation change instruction of the bow azimuth of the ship 11, the actuator control unit 11C1 of the ship control device 11C causes the actuator 11A not to change the bow azimuth of the ship 11 to the left-handed rotation, and executes the bow azimuth holding control of the ship 11 of holding the actual bow azimuth of the ship 11 at the target bow azimuth of the ship 11. That is, the target bow azimuth setting unit 11C3 sets the actual bow azimuth of the ship 11 detected by the bow azimuth detection unit 11D when the launching work start instruction input unit 131 receives the input of the start instruction of the launching work as the target bow azimuth of the ship 11 in the duration (the second duration) after the ship 11 is disengaged from the trailer 12.

For this reason, like the example shown in FIG. 4, as shown by a linear arrow in FIG. 4, the ship 11 goes straight with the actual bow azimuth of the ship 11 being held at the target bow azimuth of the ship 11.

In a still another example, the ship 11 is disengaged from the trailer 12 in the duration in which the actuator control unit 11C1 of the ship control device 11C causes the actuator 11A to change the bow azimuth of the ship 11 to the right-handed rotation according to the input of the right-handed rotation change instruction of the bow azimuth of the ship 11 received by the second bow azimuth change instruction input unit 134 of the input device 13.

When the ship 11 is disengaged from the trailer 12, the change speed of the actual bow azimuth of the ship 11 detected by the bow azimuth detection unit 11D of the ship 11 exceeds a predetermined threshold.

Here, even in this example, when the change speed of the actual bow azimuth of the ship 11 detected by the bow azimuth detection unit 11D of the ship 11 exceeds the predetermined threshold, the ship control device 11C determines that the ship 11 is disengaged from the trailer 12 (i.e., it becomes the second duration). Even when the second bow azimuth change instruction input unit 134 receives the input of the right-handed rotation change instruction of the bow azimuth of the ship 11, the actuator control unit 11C1 of the ship control device 11C causes the actuator 11A not to change the bow azimuth of the ship 11 to the right-handed rotation, and executes the bow azimuth holding control of the ship 11 of holding the actual bow azimuth of the ship 11 at the target bow azimuth of the ship 11. That is, the target bow azimuth setting unit 11C3 sets the actual bow azimuth of the ship 11 detected by the bow azimuth detection unit 11D when the launching work start instruction input unit 131 receives the input of the start instruction of the launching work as the target bow azimuth of the ship 11 in the duration (the second duration) after the ship 11 is disengaged from the trailer 12.

For this reason, like the example shown in FIG. 4, as shown by a linear arrow in FIG. 4, the ship 11 goes straight with the actual bow azimuth of the ship 11 being held at the target bow azimuth of the ship 11.

In the example shown in FIG. 4, when the backward propulsion power generating instruction input unit 132 of the input device 13 receives the input of the generating instruction of the backward propulsion power of the ship 11, the actuator control unit 11C1 of the ship control device 11C causes the actuator 11A to generate the backward propulsion power of the ship 11 in a preset duration according to the input of the generating instruction of the backward propulsion power of the ship 11 received by the backward propulsion power generating instruction input unit 132 of the input device 13 (specifically, according to the generating instruction of the backward propulsion power of the ship 11 acquired by the backward propulsion power generating instruction acquisition unit 11C5 of the ship control device 11C). After the duration elapses, the actuator 11A no longer generates backward propulsion power of the ship 11, and the launching work of the ship 11 is completed.

In the other example, only in the duration in which the backward propulsion power generating instruction input unit 132 of the input device 13 receives the input of the generating instruction of the backward propulsion power of the ship 11, the actuator control unit 11C1 of the ship control device 11C may cause the actuator 11A to generate the backward propulsion power of the ship 11. In this example, when the backward propulsion power generating instruction input unit 132 does not receive the input of the generating instruction of the backward propulsion power of the ship 11, the actuator control unit 11C1 of the ship control device 11C causes the actuator 11A not to generate the backward propulsion power of the ship 11, and the launching work of the ship 11 is completed.

In addition, when the ship 11 is disengaged from the trailer 12 in the duration in which the actuator control unit 11C1 of the ship control device 11C causes the actuator 11A to generate the backward propulsion power of the ship 11 according to the input of the generating instruction of the backward propulsion power of the ship 11 received by the backward propulsion power generating instruction input unit 132 of the input device 13, the speed of the ship 11 detected by the vessel speed detection unit 11E exceeds a predetermined threshold.

Here, in the other example, when the speed of the ship 11 detected by the vessel speed detection unit 11E exceeds the predetermined threshold, the ship control device 11C determines that the ship 11 is disengaged from the trailer 12.

When the ship control device 11C determines that the ship 11 is disengaged from the trailer 12, the actuator control unit 11C1 of the ship control device 11C causes the actuator 11A to change the bow azimuth of the ship 11 to the left-handed rotation even when the first bow azimuth change instruction input unit 133 of the input device 13 receives the input of the left-handed rotation change instruction of the bow azimuth of the ship 11, and executes the bow azimuth holding control of the ship 11 of holding the actual bow azimuth of the ship 11 at the target bow azimuth of the ship 11.

Similarly, when the ship control device 11C determines that the ship 11 is disengaged from the trailer 12, the actuator control unit 11C1 of the ship control device 11C causes the actuator 11A not to change the bow azimuth of the ship 11 to the right-handed rotation even when the second bow azimuth change instruction input unit 134 of the input device 13 receives the input of the right-handed rotation change instruction of the bow azimuth of the ship 11, and executes the bow azimuth holding control of the ship 11 of holding the actual bow azimuth of the ship 11 at the target bow azimuth of the ship 11.

Figure 5:
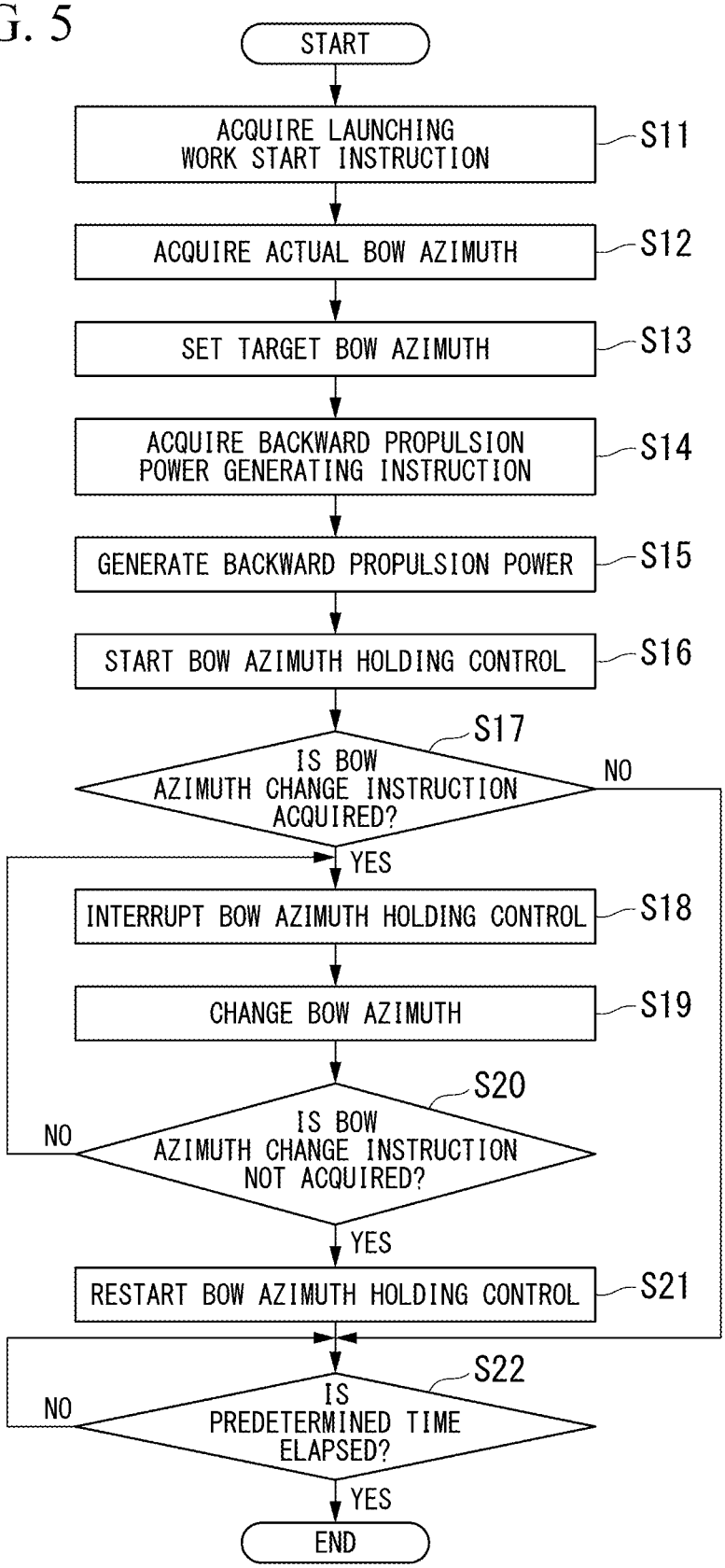
FIG. 5 is a flowchart for describing an example of processing executed in a ship control device during ship launching work in which the ship is disengaged from the trailer.

FIG. 5 is a flowchart for describing an example of processing executed in the ship control device 11C during launching work of the ship 11 in which the ship 11 is disengaged from the trailer 12.

In the example shown in FIG. 5, in step S11, the launching work start instruction acquisition unit 11C4 of the ship control device 11C acquires a start instruction of the launching work of the ship 11 transmitted from the input device 13.

In step S12, the actual bow azimuth acquisition unit 11C2 of the ship control device 11C acquires an actual bow azimuth of the ship 11 detected by the bow azimuth detection unit 11D.

In step S13, the target bow azimuth setting unit 11C3 of the ship control device 11C sets the actual bow azimuth of the ship 11 detected in step S12 as the target bow azimuth of the ship 11 during the launching work of the ship 11.

In step S14, the backward propulsion power generating instruction acquisition unit 11C5 of the ship control device 11C acquires a generating instruction of backward propulsion power of the ship 11 transmitted from the input device 13.

In step S15, the actuator control unit 11C1 of the ship control device 11C causes the actuator 11A to generate the backward propulsion power of the ship 11.

In addition, in step S16, the actuator control unit 11C1 of the ship control device 11C starts the bow azimuth holding control of the ship 11 of holding the actual bow azimuth of the ship 11 at the target bow azimuth of the ship 11. That is, the actuator control unit 11C1 of the ship control device 11C executes feedback control of a bow azimuth of the ship 11 on the basis of a deviation between the target bow azimuth and the actual bow azimuth of the ship 11.

In step S17, the ship control device 11C determines whether the bow azimuth change instruction acquisition unit 11C6 acquires a change instruction of a bow azimuth of the ship 11. The processing proceeds to step S18 when the bow azimuth change instruction acquisition unit 11C6 acquires the change instruction of the bow azimuth of the ship 11, and the processing proceeds to step S22 when the bow azimuth change instruction acquisition unit 11C6 does not acquire the change instruction of the bow azimuth of the ship 11.

In step S18, the actuator control unit 11C1 of the ship control device 11C interrupts the bow azimuth holding control of the ship 11 of holding the actual bow azimuth of the ship 11 at the target bow azimuth of the ship 11.

In step S19, the actuator control unit 11C1 of the ship control device 11C causes the actuator 11A to change the bow azimuth of the ship 11.

In step S20, the ship control device 11C determines whether the bow azimuth change instruction acquisition unit 11C6 acquires the change instruction of the bow azimuth of the ship 11. The processing proceeds to step S21 when the bow azimuth change instruction acquisition unit 11C6 does not acquire the change instruction of the bow azimuth of the ship 11, and the processing returns to step S18 when the bow azimuth change instruction acquisition unit 11C6 acquires the change instruction of the bow azimuth of the ship 11.

In step S21, the actuator control unit 11C1 of the ship control device 11C restarts the bow azimuth holding control of the ship 11 of holding the actual bow azimuth of the ship 11 at the target bow azimuth of the ship 11.

In step S22, the ship control device 11C determines whether the preset duration has passed since the backward propulsion power generating instruction acquisition unit 11C5 of the ship control device 11C acquired the backward propulsion power generating instruction of the ship 11. When the preset duration has passed since the backward propulsion power generating instruction acquisition unit 11C5 acquired the generating instruction of the backward propulsion power of the ship 11, the actuator control unit 11C1 of the ship control device 11C causes the actuator 11A not to generate the backward propulsion power of the ship 11, and terminates the launching work of the ship 11. When the preset duration has not passed since the backward propulsion power generating instruction acquisition unit 11C5 acquired the generating instruction of the backward propulsion power of the ship 11, step S22 is repeatedly executed from acquisition of the generating instruction of the backward propulsion power of the ship 11 by the backward propulsion power generating instruction acquisition unit 11C5 to the lapse of the preset duration.

In a second example of the ship launching support system 1 to which the ship control device 11C of the first embodiment is applied, the target bow azimuth setting unit 11C3 sets an azimuth (a target azimuth after splashdown) different from the actual bow azimuth of the ship 11 detected by the bow azimuth detection unit 11D when the launching work start instruction input unit 131 receives the input of the start instruction of the launching work as the target bow azimuth of the ship 11 in the duration (the second duration) after the ship 11 is disengaged from the trailer 12.

In this example, the target bow azimuth setting unit 11C3 sets the preset azimuth (the target azimuth after splashdown) as the target bow azimuth of the ship 11 in the second duration.

Second Embodiment

Hereinafter, a second embodiment of the ship launching support system, the ship control device, the ship launching support method and the program of the present invention will be described.

The ship launching support system 1 to which the ship control device 11C of the second embodiment is configured in the same manner as the ship launching support system 1 to which the ship control device 11C of the above-mentioned first embodiment is applied except the following points. Accordingly, according to the ship launching support system 1 to which the ship control device 11C of the second embodiment is applied, the same effects as the ship launching support system 1 to which the ship control device 11C of the above-mentioned first embodiment is applied can be exhibited except the following points.

Figure 6:
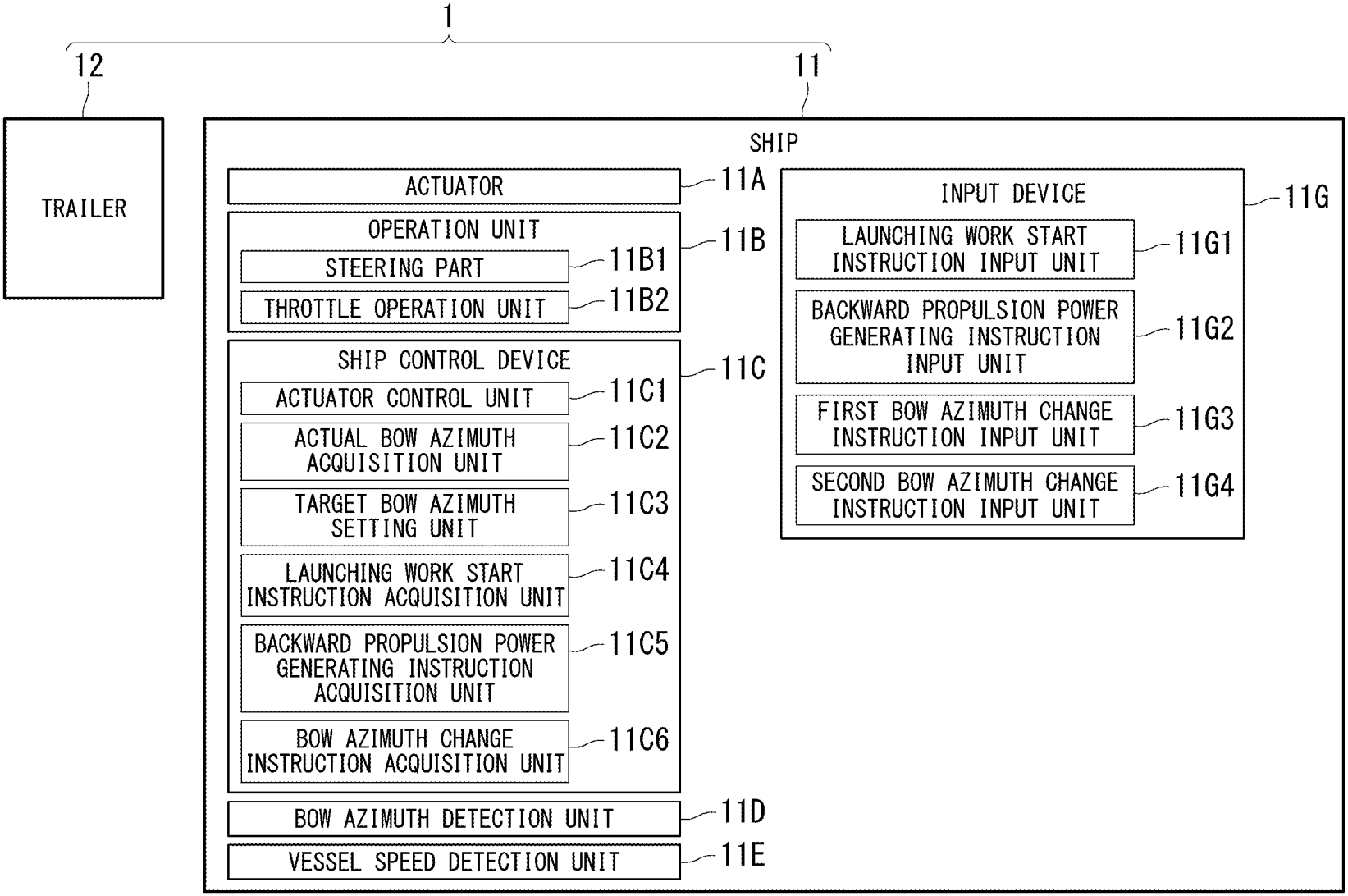
FIG. 6 is a view showing an example of a ship launching support system to which a ship control device of a second embodiment is applied.

FIG. 6 is a view showing an example of the ship launching support system 1 to which the ship control device 11C of the second embodiment is applied.

In the example shown in FIG. 6, the ship launching support system 1 includes the ship 11 and the trailer 12. The ship 11 includes the actuator 11A, the operation unit 11B, the ship control device 11C, the bow azimuth detection unit 11D, the vessel speed detection unit 11E, and an input device 11G.

The launching work start instruction acquisition unit 11C4 of the ship control device 11C acquires a start instruction of launching work of the ship 11 received by the input device 11G. The backward propulsion power generating instruction acquisition unit 11C5 acquires a generating instruction of backward propulsion power of the ship 11 received by the input device 11G. The bow azimuth change instruction acquisition unit 11C6 acquires a change instruction of a bow azimuth of the ship 11 received by the input device 11G.

The input device 11G receives an input such as a start instruction or the like of launching work of the ship 11 in which the ship 11 is disengaged from the trailer 12. The input device 11G is a plurality of buttons, a touch panel, or the like, provided in the ship 11. The input device 11G includes launching work start instruction input unit 11G1, a backward propulsion power generating instruction input unit 11G2, a first bow azimuth change instruction input unit 11G3, and a second bow azimuth change instruction input unit 11G4.

In the example shown in FIG. 6, while the throttle operation unit 11B2 and the backward propulsion power generating instruction input unit 11G2 are individually provided, in the other example, the throttle operation unit 11B2 may function as the backward propulsion power generating instruction input unit 11G2.

In the example shown in FIG. 6, the launching work start instruction input unit 11G1 receives, for example, an input of a start instruction of launching work of the ship 11 by a launching worker of the ship 11. The backward propulsion power generating instruction input unit 11G2 receives, for example, an input of a generating instruction of backward propulsion power of the ship 11 by a launching worker of the ship 11.

The first bow azimuth change instruction input unit 11G3 receives, for example, an input of a left-handed (counterclockwise) rotation change instruction of a bow azimuth of the ship 11 by a launching worker of the ship 11. The second bow azimuth change instruction input unit 11G4 receives, for example, an input of a right-handed (clockwise) rotation change instruction of a bow azimuth of the ship 11 by a launching worker of the ship 11.

In the example shown in FIG. 6, in a state in which the ship 11 is loaded on the trailer 12, the launching work start instruction input unit 11G1 of the input device 11G receives, for example, an input of a start instruction of launching work of the ship 11 by a launching worker of the ship 11. The bow azimuth detection unit 11D of the ship 11 detects an actual bow azimuth of the ship 11 when the launching work start instruction input unit 11G1 receives an input of a start instruction of launching work of the ship 11 (specifically, when the launching work start instruction acquisition unit 11C4 of the ship control device 11C acquires a start instruction of launching work of the ship 11 received by the launching work start instruction input unit 11G1).

The target bow azimuth setting unit 11C3 of the ship control device 11C sets the actual bow azimuth of the ship 11 detected by the bow azimuth detection unit 11D when the launching work start instruction input unit 11G1 receives the input of the start instruction of the launching work of the ship 11 as the target bow azimuth of the ship 11 during the launching work of the ship 11.

In the example shown in FIG. 6, after the bow azimuth detection unit 11D of the ship 11 detects the actual bow azimuth of the ship 11, the backward propulsion power generating instruction input unit 11G2 of the input device 11G receives, for example, an input of the generating instruction of backward propulsion power of the ship 11 by a launching worker of the ship 11.

Next, the actuator control unit 11C1 of the ship control device 11C causes the actuator 11A to generate backward propulsion power of the ship 11 and starts bow azimuth holding control of the ship 11 of holding the actual bow azimuth of the ship 11 at the target bow azimuth of the ship 11 according to the input of the generating instruction of the backward propulsion power of the ship 11 received by the backward propulsion power generating instruction input unit 11G2 of the input device 11G (specifically, according to the generating instruction of the backward propulsion power of the ship 11 acquired by the backward propulsion power generating instruction acquisition unit 11C5 of the ship control device 11C).

That is, during the launching work of the ship 11, the actuator control unit 11C1 of the ship control device 11C causes the actuator 11A to generate the backward propulsion power of the ship 11 and executes the feedback control of the bow azimuth of the ship 11 on the basis of the deviation between the actual bow azimuth and the target bow azimuth of the ship 11.

Meanwhile, as described above, since a frictional force is generated between the ship 11 and the trailer 12, in a state in which the actual bow azimuth of the ship 11 is held at the target bow azimuth of the ship 11, the ship 11 may not be disengaged from the trailer 12 if the actuator 11A only generates the backward propulsion power of the ship 11.

In such a case, the first bow azimuth change instruction input unit 11G3 of the input device 11G receives, for example, the input of the left-handed (counterclockwise) rotation change instruction of the bow azimuth of the ship 11 by a launching worker of the ship 11, or the second bow azimuth change instruction input unit 11G4 of the input device 11G receives, for example, the input of the right-handed (clockwise) rotation change instruction of the bow azimuth of the ship 11 by a launching worker of the ship 11.

When the first bow azimuth change instruction input unit 11G3 receives the input of the left-handed rotation change instruction of the bow azimuth of the ship 11, the actuator 11A of the ship 11 causes the ship 11 to generate a counterclockwise moment according to the input of the left-handed rotation change instruction of the bow azimuth of the ship 11 received by the first bow azimuth change instruction input unit 11G3 (specifically, according to the left-handed rotation change instruction of the bow azimuth of the ship 11 acquired by the bow azimuth change instruction acquisition unit 11C6 of the ship control device 11C).

When the second bow azimuth change instruction input unit 11G4 receives the input of the right-handed rotation change instruction of the bow azimuth of the ship 11, the actuator 11A of the ship 11 causes the ship 11 to generate a clockwise moment according to the input of the right-handed rotation change instruction of the bow azimuth of the ship 11 received by the second bow azimuth change instruction input unit 11G4 (specifically, according to the right-handed rotation change instruction of the bow azimuth of the ship 11 acquired by the bow azimuth change instruction acquisition unit 11C6 of the ship control device 11C).

As a result, the ship 11 is disengaged from the trailer 12.

Specifically, after the actuator control unit 11C1 of the ship control device 11C starts the bow azimuth holding control of the ship 11 of holding the actual bow azimuth of the ship 11 at the target bow azimuth of the ship 11, when the first bow azimuth change instruction input unit 11G3 of the input device 11G receives the input of the left-handed rotation change instruction of the bow azimuth of the ship 11, the actuator control unit 11C1 of the ship control device 11C interrupts the bow azimuth holding control of the ship 11 of holding the actual bow azimuth of the ship 11 at the target bow azimuth of the ship 11, and causes the actuator 11A to change the bow azimuth of the ship 11 to the left-handed rotation according to the input of the left-handed rotation change instruction of the bow azimuth of the ship 11 received by the first bow azimuth change instruction input unit 11G3.

After the actuator control unit 11C1 of the ship control device 11C causes the actuator 11A to change the bow azimuth of the ship 11 to the left-handed rotation, when the first bow azimuth change instruction input unit 11G3 of the input device 11G does not receive the input of the left-handed rotation change instruction of the bow azimuth of the ship 11, the actuator control unit 11C1 of the ship control device 11C restarts the bow azimuth holding control of the ship 11 of holding the actual bow azimuth of the ship 11 at the target bow azimuth of the ship 11.

In addition, after the actuator control unit 11C1 of the ship control device 11C starts the bow azimuth holding control of the ship 11 of holding the actual bow azimuth of the ship 11 at the target bow azimuth of the ship 11, when the second bow azimuth change instruction input unit 11G4 of the input device 11G receives the input of the right-handed rotation change instruction of the bow azimuth of the ship 11, the actuator control unit 11C1 of the ship control device 11C interrupts the bow azimuth holding control of the ship 11 of holding the actual bow azimuth of the ship 11 at the target bow azimuth of the ship 11, and causes the actuator 11A to change the bow azimuth of the ship 11 to the right-handed rotation according to the input of the right-handed rotation change instruction of the bow azimuth of the ship 11 received by the second bow azimuth change instruction input unit 11G4.

After the actuator control unit 11C1 of the ship control device 11C causes the actuator 11A to change the bow azimuth of the ship 11 to the right-handed rotation, when the second bow azimuth change instruction input unit 11G4 of the input device 11G does not receive the input of the right-handed rotation change instruction of the bow azimuth of the ship 11, the actuator control unit 11C1 of the ship control device 11C restarts the bow azimuth holding control of the ship 11 of holding the actual bow azimuth of the ship 11 at the target bow azimuth of the ship 11.

Application Example

In the above-mentioned example, the ship control device 11C of the first or second embodiment is applied to the ship launching support system 1 configured to support launching work of disengaging the PWC as the ship 11 from the trailer 12.

In the other example, the ship control device 11C of the first or second embodiment may be applied to the ship launching support system 1 configured to support launching work of disengaging a sports boat as the ship 11 from the trailer 12.

In still another example, the ship control device 11C of the first or second embodiment may be applied to the ship launching support system 1 configured to support launching work of disengaging a ship provided with, for example, an outboard motor disclosed in Japanese Patent No. 6198192, Japanese Unexamined Patent Application, First Publication No. 2007-22284, and the like, as the ship 11 from the trailer 12.

Hereinabove, while the present invention has been described using an embodiment, the present invention is not limited to such an embodiment, and various modifications and substitutions may be made without departing from the spirit of the present invention. The configurations disclosed in the above-mentioned embodiments and examples may be combined.

Further, all or part of the functions of the ship launching support system 1 in the above-mentioned embodiment may be realized by recording programs to realize these functions on a computer-readable recording medium, and causing a computer system to read a program recorded on the recording medium and execute it. Further, the "computer system" disclosed herein includes an OS or hardware such as peripheral devices or the like.

In addition, the "computer-readable recording medium" refers to portable media such as flexible disks, magneto-optical disks, ROMs, CD-ROMs, or the like, and storage units such as hard disks built in the computer system. Further, the "computer-readable recording medium" is a medium that dynamically holds a program for a short period of time, such as a communication line when transmitting a program via a network such as the Internet or a communication line such as a telephone line, and may also include something that holds the program for a certain period of time, such as a volatile memory inside the computer system that is a server or a client in that case. In addition, the above-mentioned program may be for realizing a part of the functions described above, or may be capable of realizing the functions described above in combination with a program already recorded in the computer system.

REFERENCE SIGNS LIST

1 . . . ship launching support system, 11 . . . ship, 11A . . . actuator, 11B . . . operation unit, 11B1 . . . steering part, 11B2 . . . throttle operation unit, 11C . . . ship control device, 11C1 . . . actuator control unit, 11C2 . . . actual bow azimuth acquisition unit, 11C3 . . . target bow azimuth setting unit, 11C4 . . . launching work start instruction acquisition unit, 11C5 . . . backward propulsion power generating instruction acquisition unit, 11C6 . . . bow azimuth change instruction acquisition unit, 11D . . . bow azimuth detection unit, 11E . . . vessel speed detection unit, 11F . . . communication unit, 11G . . . input device, 11G1 . . . launching work start instruction input unit, 11G2 . . . backward propulsion power generating instruction input unit, 11G3 . . . first bow azimuth change instruction input unit, 11G4 . . . second bow azimuth change instruction input unit, 12 . . . trailer, 13 . . . input device, 131 . . . launching work start instruction input unit, 132 . . . backward propulsion power generating instruction input unit, 133 . . . first bow azimuth change instruction input unit, 134 . . . second bow azimuth change instruction input unit, 135 . . . communication unit

The invention claimed is:

1. A ship launching support system configured to support launching work of a ship of disengaging the ship from a trailer on which the ship is loaded, the ship launching support system including the ship and an input device, the ship comprising:

an actuator having a function of generating propulsion power of the ship and a function of generating a moment on the ship; and a ship control device configured to actuate the actuator, a bow azimuth detection unit configured to detect an actual bow azimuth of the ship, wherein, the ship control device include a target bow azimuth setting unit that sets a target bow azimuth of the ship during the launching work of the ship, the input device is a terminal device separate from the ship and carried by a launching worker, during the launching work of the ship, the ship control device first causes the actuator to generate backward propulsion power of the ship, and executes feedback control of a bow azimuth of the ship on the basis of a deviation between an actual bow azimuth that is a bow azimuth of the ship moving backwards in actuality and a target bow azimuth that is set to the actual bow azimuth of the ship when the start instruction of launching work of the ship is received by the input device, in the case the ship is not able to disengage from the trailer if the actuator only generates the backward propulsion power of the ship, the input device receive an input of an instruction to change the bow azimuth of the ship, the ship control device causes the actuator to generate the counterclockwise or clockwise moment in the ship during which the input device is receiving the instruction to change the bow azimuth of the ship, after that, in the case the input device no longer receives the instruction to change the bow azimuth of the ship, the ship control device causes the actuator to generate backward propulsion power of the ship, and executes feedback control of a bow azimuth of the ship on the basis of a deviation between an actual bow azimuth that is a bow azimuth of the ship moving backwards in actuality and a target bow azimuth that is set to the actual bow azimuth of the ship after change the bow azimuth to the counterclockwise or clockwise.

2. The ship launching support system according to claim 1, comprising an input device having a launching work start instruction input unit configured to receive an input of an instruction to start the launching work, wherein the ship comprises a bow azimuth detection unit configured to detect an actual bow azimuth of the ship, the launching work start instruction input unit receives the input of the instruction to start the launching work in a state in which the ship is loaded on the trailer, and the bow azimuth detection unit detects an actual bow azimuth of the ship when the launching work start instruction input unit receives the input of the instruction to start the launching work.

3. The ship launching support system according to claim 2, wherein the target bow azimuth setting unit sets an actual bow azimuth of the ship detected by the bow azimuth detection unit when the launching work start instruction input unit receives the input of the instruction to start the launching work as at least a target bow azimuth of the ship in a first duration that is a duration from reception of the input of the instruction to start the launching work by the launching work start instruction input unit to disengagement of the ship from the trailer.

4. The ship launching support system according to claim 3, wherein the target bow azimuth setting unit sets an actual bow azimuth of the ship detected by the bow azimuth detection unit when the launching work start instruction input unit receives the input of the instruction to start the launching work as a target bow azimuth of the ship in a second duration that is a duration after the ship is disengaged from the trailer.

5. The ship launching support system according to claim 3, wherein the target bow azimuth setting unit sets an azimuth different from an actual bow azimuth of the ship detected by the bow azimuth detection unit when the launching work start instruction input unit receives the input of the instruction to start the launching work as a target bow azimuth of the ship in a second duration that is a duration after the ship is disengaged from the trailer.

6. The ship launching support system according to claim 5, wherein the target bow azimuth setting unit sets a preset azimuth as a target bow azimuth of the ship in the second duration.

7. The ship launching support system according to claim 3, wherein the input device comprises a backward propulsion power generating instruction input unit configured to receive an input of an instruction to generate backward propulsion power of the ship, and the ship control device causes the actuator to generate backward propulsion power of the ship and starts bow azimuth holding control of the ship of holding the actual bow azimuth of the ship at the target bow azimuth of the ship according to the input of the instruction to generate the backward propulsion power of the ship received by the backward propulsion power generating instruction input unit.

8. The ship launching support system according to claim 7, wherein the input device comprises a bow azimuth change instruction input unit configured to receive an input of an instruction to change a bow azimuth of the ship, after the ship control device starts the bow azimuth holding control of the ship of holding the actual bow azimuth of the ship at the target bow azimuth of the ship, when the bow azimuth change instruction input unit receives the input of the instruction to change the bow azimuth of the ship, the ship control device interrupts the bow azimuth holding control of the ship of holding the actual bow azimuth of the ship at the target bow azimuth of the ship, and causes the actuator to change the bow azimuth of the ship according to the input of the instruction to change the bow azimuth of the ship received by the bow azimuth change instruction input unit.

9. The ship launching support system according to claim 8, wherein, after the ship control device causes the actuator to change the bow azimuth of the ship, when the bow azimuth change instruction input unit does not receive the input of the instruction to change the bow azimuth of the ship, the ship control device restarts the bow azimuth holding control of the ship of holding the actual bow azimuth of the ship at the target bow azimuth of the ship.

10. The ship launching support system according to claim 8, wherein, after the ship control device starts the bow azimuth holding control of the ship of holding the actual bow azimuth of the ship at the target bow azimuth of the ship, when the bow azimuth change instruction input unit receives the input of the instruction to change the bow azimuth of the ship, the ship control device causes the actuator to change the bow azimuth of the ship by a preset angle according to the input of the instruction to change the bow azimuth of the ship received by the bow azimuth change instruction input unit.

11. The ship launching support system according to claim 8, wherein, after the ship control device starts the bow azimuth holding control of the ship of holding the actual bow azimuth of the ship at the target bow azimuth of the ship, when the bow azimuth change instruction input unit receives the input of the instruction to change the bow azimuth of the ship, in a duration in which the bow azimuth change instruction input unit receives the input of the instruction to change the bow azimuth of the ship, the ship control device causes the actuator to increase a change amount of the bow azimuth of the ship by a preset angle whenever a predetermined time elapses.

12. The ship launching support system according to claim 7, wherein, when the backward propulsion power generating instruction input unit receives the input of the instruction to generate backward propulsion power of the ship, the ship control device causes the actuator to generate backward propulsion power of the ship in a preset duration.

13. The ship launching support system according to claim 8, wherein, when a change speed of an actual bow azimuth of the ship detected by the bow azimuth detection unit exceeds a predetermined threshold in a duration in which the ship control device causes the actuator to change a bow azimuth of the ship according to the input of the instruction to change the bow azimuth of the ship received by the bow azimuth change instruction input unit, the ship control device causes the actuator not to change the bow azimuth of the ship, and executes the bow azimuth holding control of the ship of holding the actual bow azimuth of the ship at the target bow azimuth of the ship despite the bow azimuth change instruction input unit receiving an input of an instruction to change the bow azimuth of the ship.

14. The ship launching support system according to claim 8, wherein the ship comprises a vessel speed detection unit configured to detect a speed of the ship, when the speed of the ship detected by the vessel speed detection unit exceeds a predetermined threshold in a duration in which the ship control device causes the actuator to generate backward propulsion power of the ship according to the input of the instruction to generate the backward propulsion power of the ship received by the backward propulsion power generating instruction input unit, the ship control device executes the bow azimuth holding control of the ship of holding the actual bow azimuth of the ship at the target bow azimuth of the ship without causing the actuator to change the bow azimuth of the ship despite the bow azimuth change instruction input unit receiving the input of the instruction to change the bow azimuth of the ship.

15. A ship comprising:

an actuator having a function of generating propulsion power of a ship and a function of generating a moment in the ship, a ship control device configured to actuate the actuator, a bow azimuth detection unit configured to detect an actual bow azimuth of the ship, wherein, the ship control device includes a target bow azimuth setting unit that sets a target bow azimuth of the ship during the launching work of the ship, wherein the ship is communicable with an input device that is a terminal device separate from the ship and carried by a launching worker; and wherein, during launching work of the ship in which the ship is disengaged from a trailer on which the ship is loaded, the ship control device first causes the actuator to generate backward propulsion power of the ship, and executes feedback control of a bow azimuth of the ship on the basis of a deviation between the actual bow azimuth of the ship moving backwards in actuality and the target bow azimuth that is set to the actual bow azimuth of the ship when the start instruction of launching work of the ship is received by the input device, in the case the ship is not able to disengage from the trailer if the actuator only generates the backward propulsion power of the ship, the input device receive an input of an instruction to change the bow azimuth of the ship, the ship control device causes the actuator to generate the counterclockwise or clockwise moment in the ship during which the input device is receiving the instruction to change the bow azimuth of the ship, after that, in the case the input device no longer receives the instruction to change the bow azimuth of the ship, the ship control device causes the actuator to generate backward propulsion power of the ship, and executes feedback control of a bow azimuth of the ship on the basis of a deviation between an actual bow azimuth that is a bow azimuth of the ship moving backwards in actuality and a target bow azimuth that is set to the actual bow azimuth of the ship after change the bow azimuth to the counterclockwise or clockwise.

16. A ship launching support method of supporting launching work of a ship of disengaging the ship from a trailer on which the ship is loaded, the ship comprising an actuator having a function of generating propulsion power of the ship and a function of generating a moment in the ship and a ship control device configured to actuate the actuator, the ship is communicable with an input device that is a terminal device separate from the ship and carried by a launching worker, the ship launching support method comprising:

during the launching work of the ship, a backward propulsion power generating step of causing the actuator to generate backward propulsion power of the ship; and a feedback control step of executing feedback control of a bow azimuth of the ship on the basis of a deviation between an actual bow azimuth of the ship moving backwards in actuality and a target bow azimuth that is set to the actual bow azimuth of the ship when the start instruction of launching work of the ship is received by the input device, a bow azimuth detection step of detecting an actual bow azimuth of the ship, in the case the ship is not able to disengage from the trailer if the actuator only generates the backward propulsion power of the ship, the input device receive an input of an instruction to change the bow azimuth of the ship, causing the actuator to generate the counterclockwise or clockwise moment in the ship during which the input device is receiving the instruction to change the bow azimuth of the ship, after that, in the case the input device no longer receives the instruction to change the bow azimuth of the ship, causing the actuator to generate backward propulsion power of the ship, and executes feedback control of a bow azimuth of the ship on the basis of a deviation between an actual bow azimuth that is a bow azimuth of the ship moving backwards in actuality and a target bow azimuth that is set to the actual bow azimuth of the ship after change the bow azimuth to the counterclockwise or clockwise.

17. A non-transitory computer-readable storage medium storing a program configured to cause a computer mounted on a ship comprising an actuator having a function of generating propulsion power of the ship and a function of generating a moment in the ship and a ship control device configured to actuate the actuator, the ship is communicable with an input device that is a terminal device separate from the ship and carried by a launching worker, to execute:

during the launching work of the ship, a backward propulsion power generating step of causing the actuator to generate backward propulsion power of the ship; and a feedback control step of executing feedback control of a bow azimuth of the ship on the basis of a deviation between a target bow azimuth and an actual bow azimuth of the ship, during launching work of the ship of disengaging the ship from a trailer on which the ship is loaded, a bow azimuth detection step of detecting an actual bow azimuth of the ship moving backwards in actuality and a target bow azimuth that is set to the actual bow azimuth of the ship when the start instruction of launching work of the ship is received by the input device, in the case the ship is not able to disengage from the trailer if the actuator only generates the backward propulsion power of the ship, the input device receive an input of an instruction to change the bow azimuth of the ship, causing the actuator to generate the counterclockwise or clockwise moment in the ship during which the input device is receiving the instruction to change the bow azimuth of the ship, after that, in the case the input device does not receive the instruction to change the bow azimuth of the ship, causing the actuator to generate backward propulsion power of the ship, and executes feedback control of a bow azimuth of the ship on the basis of a deviation between an actual bow azimuth that is a bow azimuth of the ship moving backwards in actuality and a target bow azimuth that is set to the actual bow azimuth of the ship after change the bow azimuth to the counterclockwise or clockwise.

* * * * *